US005716267A

United States Patent [19]

Hambleton et al.

[11] Patent Number: 5,716,267

[45] Date of Patent: Feb. 10, 1998

[54] FUME HOOD WITH SECONDARY EXHAUST COLLECTION DEVICE

[75] Inventors: Larry G. Hambleton, Olathe, Kans.; Gary P. Roepke, Blue Springs; Gerald J. O'Dell, Independence, both of Mo.; Kevin C. Gilkison, Olathe, Kans.

[73] Assignee: Labconco Corporation, Kansas City, Mo.

[21] Appl. No.: 579,871

[22] Filed: Dec. 28, 1995

[51] Int. Cl.[6] ..... B08B 15/02

[52] U.S. Cl. ..... 454/56; 454/67

[58] Field of Search ..... 454/56, 62, 67; 126/299 F

[56] References Cited

U.S. PATENT DOCUMENTS

| | | | |
|---|---|---|---|
| 2,833,528 | 5/1958 | Schroeder | 126/299 F X |
| 3,559,383 | 2/1971 | McCabe | 454/56 X |
| 3,713,785 | 1/1973 | Moran | 454/56 X |
| 4,252,054 | 2/1981 | Bakels | 454/56 X |
| 4,825,848 | 5/1989 | Macias | 454/67 X |
| 4,852,468 | 8/1989 | Harris | 454/56 |
| 5,133,689 | 7/1992 | Aalto et al. | 454/49 |

FOREIGN PATENT DOCUMENTS

| | | | |
|---|---|---|---|
| 700286 | 12/1964 | Canada | 126/299 F |

*Primary Examiner*—Harold Joyce

*Attorney, Agent, or Firm*—Shook, Hardy & Bacon L.L.P.

[57] ABSTRACT

A laboratory fume hood has a cabinet structure, which defines an enclosed work area, and a primary exhaust assembly. The primary exhaust assembly serves to contain fumes within the work area and then exhaust the fumes. It effects a flow of a volume of air through the work area and in many instances is designed to maintain a constant face velocity across an access opening in the front wall of the fume hood. A secondary collection device is disposed within the fume hood for removing a concentration of fumes from a small portion of the work area. The secondary collection device includes a collector head disposed in the work area and a conduit connected to the primary exhaust assembly. A portion of the air flowing through the work area is directed to the primary exhaust assembly through the secondary collection device. The volume of air passing through the secondary device should not be high enough to adversely affect the containment capabilities of the primary exhaust assembly. A blower may be provided to facilitate air flow through the secondary collector. A scrubber assembly or carbon filter assembly may be coupled with the primary exhaust assembly to purify the air collected by the secondary collection device.

9 Claims, 1 Drawing Sheet

FUME HOOD WITH SECONDARY EXHAUST COLLECTION DEVICE

BACKGROUND OF THE INVENTION

This invention relates generally to fume hoods and, more particularly, to a method and apparatus which provides for a secondary system for removing fumes from a portion of a fume hood in cooperation with the primary exhaust system.

So called laboratory fume hoods are ventilated enclosures where hazardous materials can be handled safely. The purpose of the hood is to contain contaminants generated during scientific investigations and prevent their escape into the laboratory. This is accomplished by controlling contaminants in the form of gases and vapors present in the hood work area away from the user so that inhalation is avoided and contact reduced.

Air flow into fume hoods of known design is achieved by an exhaust blower which "pulls" air from the laboratory room into and through the hood and its associated exhaust system. This "pull" at the opening of the hood is measured as face velocity. Typically, fume hoods of the prior art include a movable panel or sash at the access opening for providing access to the work area. This sash can be moved to different heights to accommodate positioning of hands and arms in the work area.

It is, of course, essential to provide an adequate face velocity for any laboratory fume hood so as to ensure containment of the fumes or other contaminants and to ensure that these contaminants will ultimately be removed through the exhaust system. The amount of air available for moving through a fume hood will depend upon room conditions. Variations in the building HVAC system can influence operation of a fume hood. Another variable which can affect fume hood operation is objects such as flask or burner stands which are left inside the fume hood work area. The presence of such objects affects the flow of air through the work area of the hood.

Because of the variables which affect fume hood operation, a reliable hood must be designed to operate effectively under a range of varying conditions. To this end, it has long been recognized that maintaining a constant face velocity (i.e. the rate of air flow into the work area across the access opening) is desirable to maximize fume hood efficiency and promote containment of fumes within the work area. It is generally recognized that a standard face velocity of 100 ft. per minute (fpm) is desirable where an access opening measuring approximately 2'×4' should pass a volume of approximately 750 cubic feet per minute (cfm) of air.

It is also known to equip fume hoods with either a carbon filter assembly (e.g. a carbon adsorber) or a large roof mounted scrubber assembly to at least partially purify air exhausted from a fume hood. Such equipment is relatively expensive, however, to both install and maintain. Nevertheless, government regulations and other air quality concerns continue to restrict the type and quantity of materials which may be discharged directly into the atmosphere. Thus, it is becoming increasingly important to develop more cost effective methods for utilizing filters and scrubbers where these accessories are required.

SUMMARY OF THE INVENTION

The present invention relates to a fume hood having a secondary collection device in the work area of the fume hood. The invention improves upon prior art fume hood designs by accommodating a significant air flow through the secondary collection device without compromising the face velocity of the fume hood.

Accordingly, it is an object of the present invention to provide a secondary collection device for removing fumes from the work area of a fume hood.

It is also an object of this invention to provide a method for collecting and removing fumes from a portion of the work area of a fume hood by redirecting a volume of air from the work area which would otherwise pass through the primary exhaust to a secondary collection device.

It is another object of this invention to provide a method and apparatus for directing a volume of air through a secondary collection device in the work area of a fume hood while maintaining a sufficient face velocity for containment purposes within the fume hood.

It is yet another object of this invention to provide a method and apparatus for effecting a flow of air through the work area so that a portion of the total volume of air passing through the work area flows through a secondary collection device without interfering with the exhaust and containment functions of the primary exhaust system.

A further object of this invention is to provide a method and apparatus for collecting and removing a concentration of fumes or other contaminants from a relatively small portion of an enclosed work area using a secondary collection device.

Yet a further object of this invention is to provide a method and apparatus for purifying the air collected by a secondary collection device in the work area before the air is vented to the atmosphere.

These and other related objects of the present invention will become readily apparent upon further review of the specification and drawings. To accomplish the objects of the present invention, a secondary collection device is provided inside a fume hood. The secondary collection device comprises a collector head disposed in the work area and a conduit coupled to the primary exhaust assembly of the fume hood. The primary exhaust assembly is adapted to effect the flow of a volume of air through the work area, and a portion of this volume is redirected through the secondary collection device. A blower or fan may be coupled to the secondary collection device to facilitate the flow of air to the primary exhaust assembly.

In another aspect, the invention is related to purifying the air passing through the secondary collection device before the air is vented from the fume hood into the atmosphere. By limiting the volume of air cleaned by the purifier to that passing through the secondary collection device, the size of the purifying equipment can be greatly reduced. Further, the smaller purifier will be less expensive to purchase, operate and maintain. For example, a scrubber assembly may be provided within the fume hood for separating and removing any water miscible contaminants from the air. Likewise, organic vapors passing through the secondary collection device may be adsorbed by a carbon filter before the air is exhausted out of the fume hood.

BRIEF DESCRIPTION OF THE DRAWINGS

In the accompanying drawings which form a part of the specification and are to be read in conjunction therewith and in which like reference numerals are used to indicate like parts in the various views.

DESCRIPTION OF THE PREFERRED EMBODIMENT

Figure 1:
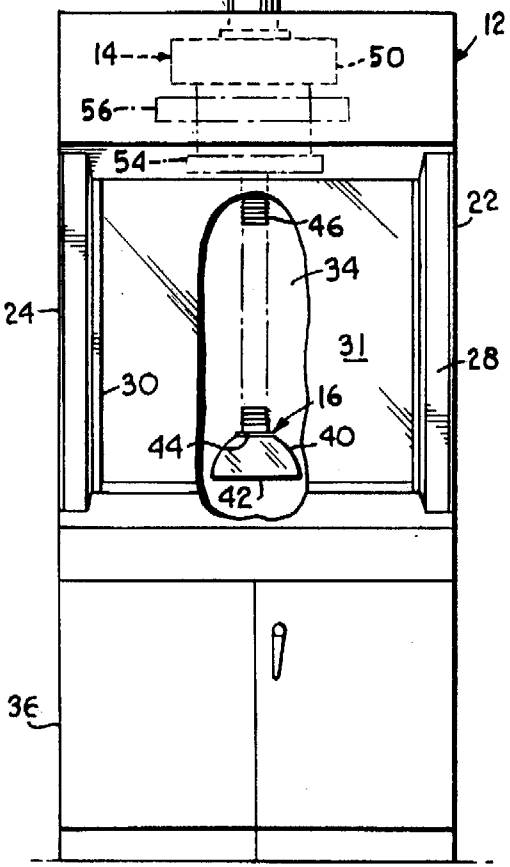
FIG. 1 is a front elevational view of the fume hood of the present invention with a portion broken away to illustrate the secondary collection device of the present invention and with phantom lines representing the secondary blower and the scrubber assembly.

Referring to the drawings in greater detail, and initially to FIG. 1, the fume hood of the present invention is designated generally by reference numeral 10. The fume hood 10 comprises a cabinet structure 12, a primary exhaust assembly 14 and a secondary collection device 16.

Figure 3:
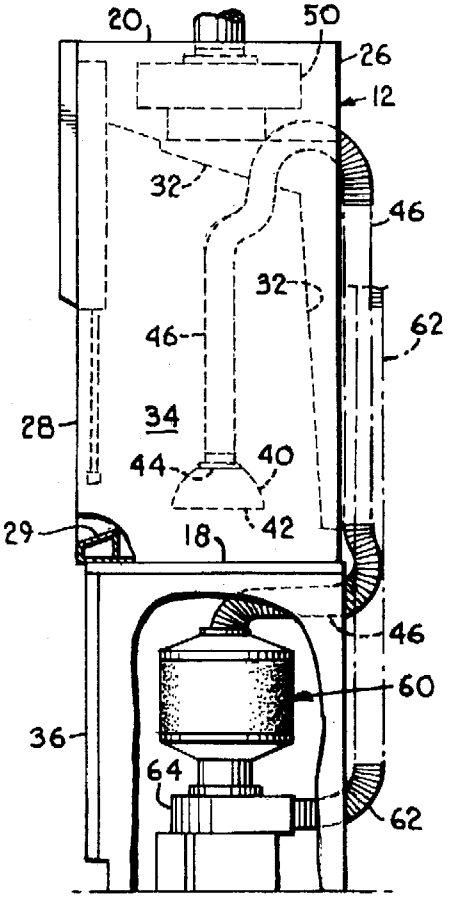
FIG. 3 is an end elevational view of the fume hood of FIG. 2 with a portion broken away to illustrate the carbon filter assembly.
Figure 2:
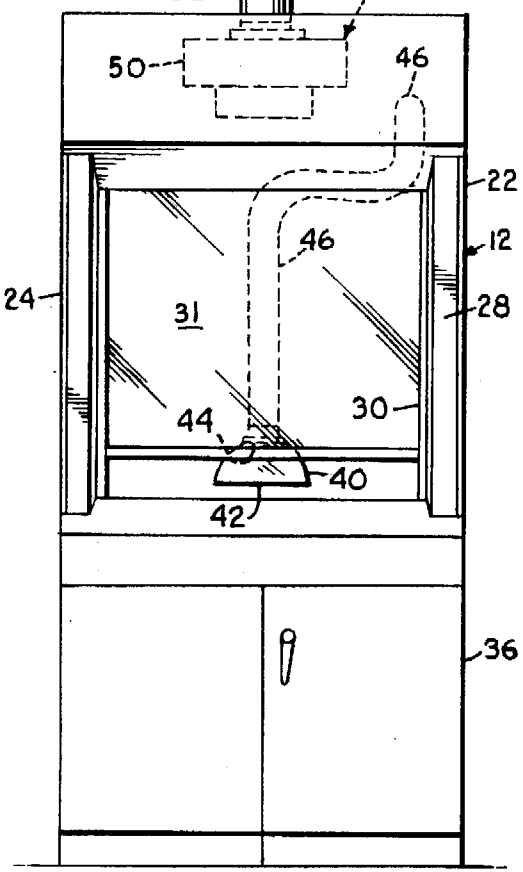
FIG. 2 is a front elevational view of the fume hood in accordance with an alternative embodiment of the present invention with phantom lines representing the secondary blower.

Although FIGS. 2 and 3 are directed to an alternative embodiment of the present invention, many of the features of the preferred embodiment are also present in the alternative embodiment. Accordingly, reference will be made to FIGS. 2 and 3 in describing the preferred embodiment, and reference will also be made to FIG. 1 in describing the alternate embodiment shown in FIGS. 2 and 3. Based on the following discussion, those skilled in the art will readily distinguish the features common to both embodiments from the features specific to each embodiment.

With reference to FIGS. 2 and 3, the cabinet structure 12 includes a planar work surface 18, an upper wall 20, a pair of side walls 22 and 24, a back wall 26 and a front wall 28 having an access opening 30 which is closed by a vertically mounted sash 31. An air foil 29 assures continuous sweeping action of the air entering the hood for effective fume removal at all times. Sash 31 is movable between a lowered closed position and a raised open position. Typically, the cabinet structure 12 will also include a baffle 32 associated with the primary exhaust assembly 14. In any event, the cabinet structure 12 defines an enclosed work area 34 within the fume hood 10. As is well known in the art, baffle 32 presents an air directional surface for directing air and fumes from the lower portion of work area 34 to exhaust assembly 14. Structure 12 may also include a base cabinet 36 to provide storage space or to accommodate additional equipment.

The secondary collection device 16 is disposed above the work surface 18 in the work area 34. Device 16 includes a collector head 40 having an inlet 42 and an outlet 44. Device 16 also includes a conduit 46 extending outwardly from outlet 44. The conduit 46 may be directly connected to the exhaust assembly 14 (as in FIG. 1) or it may be coupled to assembly 14 through another device (as in FIG. 3).

As shown in FIGS. 1 and 2, primary exhaust assembly 14 includes a hood blower 50 and a hood vent 52 disposed near the top of the fume hood 10. Alternatively, blower 50 could be disposed remotely (i.e., outside of hood 10). Assembly 14 may also include a booster fan or secondary blower 54 if deemed necessary to provide sufficient drawing power for collection device 16. Optionally, assembly 14 is coupled with either a scrubber assembly 56 or a carbon adsorber assembly 60 (FIG. 3). Scrubber assembly 56 is well known to those skilled in art and includes a plurality of nozzles for delivery of water and an appropriate collection system. Filter assembly 60 is coupled with device 16 via conduit 46. Assembly 60 also includes a secondary blower 64. The blower outlet is coupled with hood blower 50 via conduit 62. It is presently preferred for carbon adsorber assembly 60 to include a pre-filter, an activated carbon filter, and a safety filter. Scrubber assemblies and carbon filter assemblies are well known to those skilled in the fume hood art and will not be described in further detail herein.

In operation, a chemical experiment or related activity may be conducted within fume hood 10 by first raising sash 31 to access work area 34 through opening 30. The exhaust assembly 14 effects a flow of air through work area 34 which is facilitated by maintaining a constant face velocity across opening 30. Generally, the minimum face velocity for a fume hood is 60 fpm, and a face velocity of 100 fpm is considered normal for most hoods. A total air flow of 750 cubic feet per minute (cfm) is normal for a 2'×4' hood opening. In the preferred embodiment, approximately 5 to 20 percent of the volume of air flowing through the work area which would otherwise pass through the exhaust assembly 14 will be redirected through device 16. Thus, in the preferred embodiment, and assuming an opening approximately 2'×4' approximately 50 to 125 cubic feet of air should travel through device 16 every minute when the total volume of air flow through the hood is 750 cfm. A most preferred flow volume through assembly 14 is ten percent (10%) of the total air flow through the hood or approximately 75 cfm in the case of a standard hood having an approximately eight square foot opening. In general, the criteria for the volume of air passing through secondary collection device 16 is a level effective for collecting fumes from a limited area within the hood enclosure without adversely affecting the containment capabilities of the primary exhaust assembly within the hood.

Typically, a fume source such as a beaker or flask containing chemicals is placed on work surface 18. The fume source and the device 16 are preferably positioned so that the source is in relatively close proximity to collector head 40 of device 16, which significantly reduces the likelihood of fumes drifting out of opening 30 and in turn reduces the required minimum face velocity of the fume hood 10. In this way, the fumes from the source will be collected through inlet 42 of collector head 40 and passed into conduit 46 through outlet 44. Conduit 46 should be flexible enough to allow for frequent repositioning such as placing the pickup head 40 at an angle or moving device 16 out of the way when it is not being used.

In the simplest embodiment of the present invention, conduit 46 directs the air passing therethrough into primary exhaust assembly 14 without the benefit of secondary blower 54. In some instances, however it will be desirable to utilize blower 54 to enhance the drawing power at collector head 40. In other applications assembly 14 may be coupled with scrubber assembly 56, which removes contaminants from the air before it is exhausted out of fume hood 10 through hood vent 52. The volume of air directed into collector head 40 may vary depending on the diameter of conduit 46.

As mentioned previously, FIGS. 2 and 3 depict another alternative embodiment wherein conduit 46 is connected to carbon filter assembly 60 located in base cabinet 36. Assembly 60 purifies the air collected by device 16. For example, assembly 60 may remove organic vapors, acid vapors, formaldehyde or ammonia from the air captured by device 16. Blower 64 directs the purified air through conduit 62 to blower 50.

Although neither scrubber assembly 56 nor carbon filter assembly 60 is a necessary feature of fume hood 10, it is becoming increasingly important to purify the air passing through the fume hood prior to its exhaust into the environment. Following purification, the air may be re-entrained into primary exhaust assembly 14. It should be noted that scrubber assembly 56 may be coupled with assembly 14 at the top of fume hood 10 as shown in FIG. 1, or it may be located in base cabinet 36. Likewise, carbon filter assembly 60 is shown inside base cabinet 36 in FIG. 3, but it may alternatively be located above work surface 18 near the top of fume hood 10. Blower 64 may not be required for the alternative embodiment, especially if assembly 60 is located near the hood blower 50.

Those skilled in the art will readily appreciate a number of modifications to the preferred and alternative embodiments of the disclosed fume hood. Depending on the nature of the experiment at hand, it may be desirable to replace collector head 40 with another collector head having a different shape or size. Collector head 40 may be adapted for mounting a light or other attachment thereon. Conduit 46 could be connected to assembly 14 through an exhaust chimney at the back of the fume hood, or conduit 46 might be disposed in base cabinet 36 if the collector 40 is disposed in or below work surface 18. If two separate experiments are being conducted simultaneously, it may be desirable to provide an additional secondary collection device 16 within fume hood 10. Of course, any such modification to the preferred embodiments disclosed herein must not compromise the fume hood's constant face velocity, which must remain relatively uniform across opening 30.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A secondary collection device for removing fumes from the work area of a fume hood, wherein the fume hood includes a cabinet structure having a work surface, the fume hood further including a primary exhaust assembly adapted to effect the flow of a volume of air through the work area, said secondary collection device comprising:

a collector head disposed in the work area and above, the work surface, said collector head having an inlet for collecting fumes from the work area; and a conduit communicating with the collector head and coupled to the primary exhaust assembly, wherein the fumes collected by the collector head pass through the conduit and into the primary exhaust assembly to exit the fume hood.

2. The device of claim 1, further comprising a purifier assembly coupled with the primary exhaust assembly for filtering selected contaminants out of the air flowing through the work area before exhausting the air out of the fume hood.

3. The device of claim 2, wherein the purifier assembly is a scrubber.

4. The device of claim 2, wherein the purifier assembly is a carbon filter.

5. The device of claim 1, wherein approximately five to twenty percent of the volume of air flowing through the work area is directed to the primary exhaust assembly through the collector head and the conduit.

6. The device of claim 1, wherein approximately ten percent of the volume of air flowing through the work area is directed to the primary exhaust assembly through the collector head and the conduit.

7. The device of claim 1, further comprising a secondary blower coupled to the conduit for facilitating the flow of air from the work area to the primary exhaust assembly through the collector head and the conduit.

8. The device of claim 1, wherein said conduit is adapted to be adjustable so that said collector head may be disposed in a plurality of locations within the work area.

9. The device of claim 1, wherein said conduit includes means for collecting at least a portion of the fumes from the work area which would otherwise pass through the primary exhaust assembly and for directing same into the primary exhaust assembly.

* * * * *